US006935464B2

(12) United States Patent
Duan

(10) Patent No.: US 6,935,464 B2
(45) Date of Patent: Aug. 30, 2005

(54) EXTENSION LADDER HAVING AN ANTI-SLIPPING MECHANISM

(75) Inventor: Guodong Duan, Tianjin (CN)

(73) Assignee: Jie Li, Tianjin (CN)

( * ) Notice: Subject to any disclaimer, the term of this patent is extended or adjusted under 35 U.S.C. 154(b) by 40 days.

(21) Appl. No.: 10/660,187

(22) Filed: Sep. 11, 2003

(65) Prior Publication Data

US 2004/0045770 A1 Mar. 11, 2004

(30) Foreign Application Priority Data

Sep. 11, 2002 (CN) ..... 02253605 U

(51) Int. Cl.[7] ..... E06C 7/06
(52) U.S. Cl. ..... 182/213; 182/212; 182/209
(58) Field of Search ..... 182/207, 210, 182/209, 211, 212, 213

(56) References Cited

U.S. PATENT DOCUMENTS 4,364,451 A * 12/1982 Wright ..... 182/213
4,605,100 A * 8/1986 Inglese ..... 182/213
4,640,387 A * 2/1987 Bocker ..... 182/213

OTHER PUBLICATIONS http://www.jinamo.com/index.htm; pp. 1–2.
http://www.jinamo.com/jinamoladder.htm; pp. 1–11, no month & date available.
http://www.jinamo.com/ladder/Large/LCS330GFA.jpg, no month & date available.

* cited by examiner

*Primary Examiner*—Hugh B. Thompson, II
(74) *Attorney, Agent, or Firm*—Baker & Hostetler LLP

(57) ABSTRACT

An extension ladder assembly having an anti-slipping mechanism is provided. The extension ladder includes a master ladder, a slave ladder, a pulley, a locking mechanism, the antislipping mechanism and adjustable ladder feet. The master ladder and the slave ladder are each composed of two posts and several rungs. The master ladder and the slave ladder are each composed of two posts and several rungs. The master ladder is slightly wider than the slave ladder. The anti-slipping mechanism prevents the slave ladder from being tripped and slid down, thereby safeguarding the safety of a user of the ladder. The pulley and the locking mechanism make the extension ladder suitable for various height requirements on work sites. The adjustable ladder feet make the extension ladder stand firm and secure by fine and minor adjustment of angles to accommodate different surface or ground conditions the ladder is placed upon. The ladder posts are made of glass fiber reinforced plastic section material thereby, providing strength to the ladder.

20 Claims, 9 Drawing Sheets

EXTENSION LADDER HAVING AN ANTI-SLIPPING MECHANISM

PRIORITY

This application claims priority under 35 U.S.C. Section 119 from a Chinese patent application filed on Sep. 11, 2002 and assigned Chinese Patent Application Filing Number 02253605.1, the contents of this Chinese patent application are incorporated herein by reference in their entirety.

TECHNICAL FIELD

This invention relates to an extension ladder, and more particularly to an extension ladder having an anti-slipping mechanism.

BACKGROUND OF THE INVENTION

Common extension ladders are retractable ladders. Two extension ladders are disclosed in Chinese Patent Nos. 95117319.7 and 98238755.5, and firm and tough ladders, such as firefighter-type ladders made of glass fiber reinforced plastic material, are disclosed in Chinese Patent No. 94230386.5. However, the ladders in the prior art still cannot meet such requirements as simple structure, firm, secure, retractable and easily-adjustable. Moreover, extension ladders in the prior art urgently need to be provided with a simple and reliable safety device to prevent tripping and slipping of such ladders so as to ensure the safety of an individual on such extension ladders.

SUMMARY OF THE INVENTION

Accordingly, it is an aspect of the present invention to overcome the foregoing disadvantages of prior art ladders, especially extension ladders, and provide an extension ladder that is not only firm and secure, but also retractable and adjustable.

It is another aspect of the present invention to provide an extension ladder that has an anti-slipping mechanism to prevent tripping and slipping of the ladder.

According to these and other aspects, the present invention provides an extension ladder having an anti-slipping mechanism. The ladder includes a master ladder, a slave ladder, a pulley, a locking mechanism, the anti-slipping mechanism and adjustable ladder feet. The master ladder and the slave ladder are parallel with respect to each other and are assembled together to form the ladder assembly. The master ladder and the slave ladder are each composed of two posts and a plurality of rungs arranged in a spaced-apart configuration with respect to each other. Each of the plurality of rungs is arranged perpendicular with respect to its respective post. The master ladder is slightly wider than the slave ladder.

Preferably, the master ladder posts and the slave ladder posts are made of glass fiber reinforced plastic section material with a square G-shaped cross section. The master ladder posts open inwardly (towards the rungs), and the slave ladder posts open outwardly (away from the rungs). The master ladder posts and the slave ladder posts interlock, and are oriented side-by-side with each other in a locked configuration.

In the pulley, a fixed pulley is installed in the middle of the top rung of the master ladder through a pulley yoke; a rope rides on the pulley with one end being fixed to a link rod of the anti-slipping mechanism secured to the slave ladder posts. The slave ladder is raised up when the rope is pulled, and lowered down when the rope is released.

In the locking mechanism, a pair of identical locking mechanisms are provided at the lower section of the slave ladder; each of the two locking mechanisms includes a claw hook, a ratchet, and a torsion spring. A hinge hole is provided at the end of a vertex angle of the claw hook. A claw hook stand is installed at the inside of the slave ladder post and is used to let the claw hook and the slave ladder post be spaced apart. The claw hook is hung up from the claw hook stand by means of a hinge member. A hooking area is defined by the claw hook for hooking master and slave rungs.

In the anti-slipping mechanism, a pair of anti-slipping mechanisms are provided each having a latch hook and a latch hook stand installed at the inside of the slave ladder post and is used to space apart the latch hook and the slave ladder post. Each latch hook stand is provided with a hook stop. The anti-slipping mechanism includes the link rod and a pair of identical latch hooks fixed on both ends of the link rod. Each latch hook is triangular shaped with a hinge on a vertex angle, and is hung up from its respective latch hook stand by means of a hinge member.

A first hooking area is defined at the long side of the latch hook and can be extended inwardly to hook the rung of the slave ladder. In particular, the latch hooks hook the lowermost rung of the slave ladder. An indentation that matches or corresponds to the hook stop is provided on the long side of each latch hook. A second hooking area extending inwardly for hooking and supporting a rung of the master ladder is defined on the side opposite the long side. Reducing joining sections are formed at both ends of the link rod and are movably connected to connection holes at the ends of the latch hook to secure the link rod to the latch hooks. As stated above, one end of the rope is fixed to the link rod. In particular, one end of the rope is fixed to a central portion of the link rod.

Two identical adjustable ladder feet are connected at the bottom of the master ladder posts using ladder feet connection pieces. The adjustable ladder feet are provided with curved grooves to hold the ladder feet hinge members; the hinge members can move along the curved grooves for moving the adjustable ladder feet along a circular path. Protection teeth are provided at the front ends of the adjustable ladder feet. Anti-slipping plates with concave and convex ridges are installed on the adjustable ladder feet for providing a gripping surface to the adjustable ladder feet.

Preferably, in the anti-slipping extension ladder in accordance with the present invention, anti-wearing sleeves are installed on each rung of the master ladder such that they contact the two slave ladder posts. Corner guards are installed on the top of each ladder post. An internal position limiting plate is installed at the lower part of the two slave ladder posts, and an external position limiting plate is installed at the upper part of the two master ladder posts. The claw hook of the locking mechanisms includes torsion springs at the hinge points of the claw hook and the ratchet. The latch hook of the anti-slipping mechanism includes a torsion spring at the hinge point of the latch hook with the slave ladder post.

Compared with prior art ladders, the extension ladder having an anti-slipping mechanism of the present invention has significant advantages and positive effects. It is known from the above technical scheme that the extension ladder in accordance with this invention, with its structural configuration, has at least the following advantages:

First, the anti-slipping mechanism prevents the slave ladder from being tripped and slid down, thereby safeguarding the safety of a user of the ladder. Second, the pulley and the locking mechanism make the extension ladder suitable for various height requirements on work sites.

Third, the adjustable ladder feet make the extension ladder stand firm and secure by fine and minor adjustment of angles to accommodate different surface or ground conditions the ladder is placed upon. The adjustable ladder feet are insulated and durable, and prevent slipping. Fourth, the ladder posts are made of glass fiber reinforced plastic section material, thereby providing strength to the ladder.

DETAILED DESCRIPTION OF THE PREFERRED EMBODIMENTS

Figure 1A:
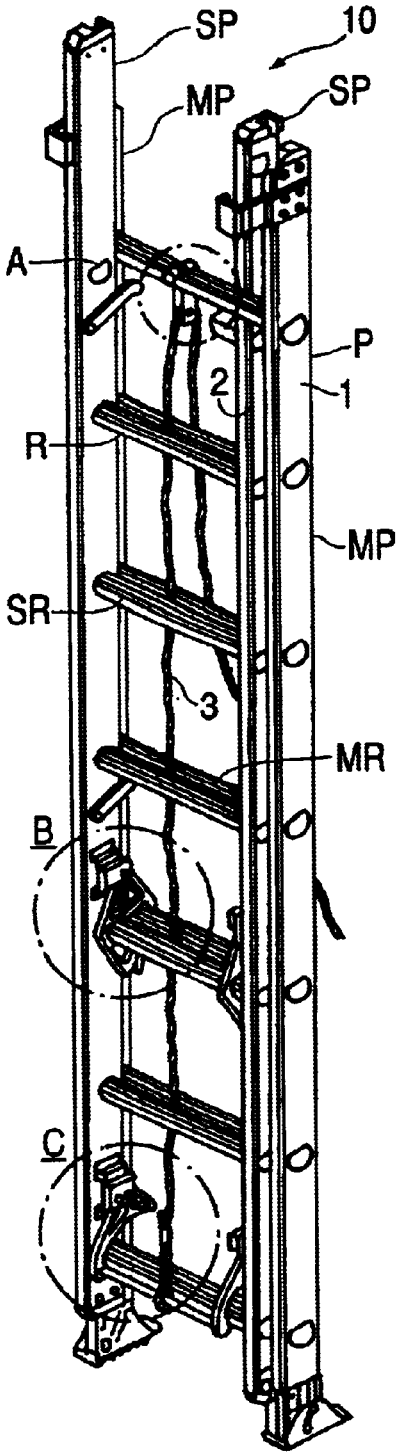
FIG. 1A is a perspective view of the overall structure of an extension ladder having an anti-slipping mechanism in accordance with the present invention.
Figure 1B:
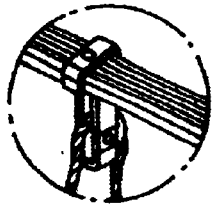
FIGS. 1B, 1C and 1D are enlarged views for regions A, B and C shown in FIG. 1A, respectively.
Figure 1C:
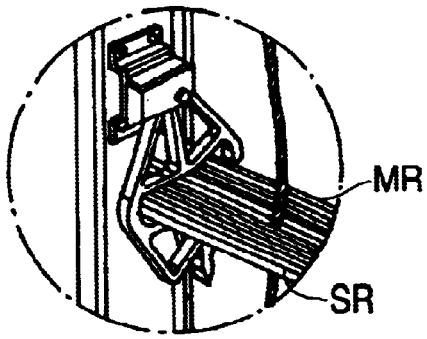
Figure 1D:
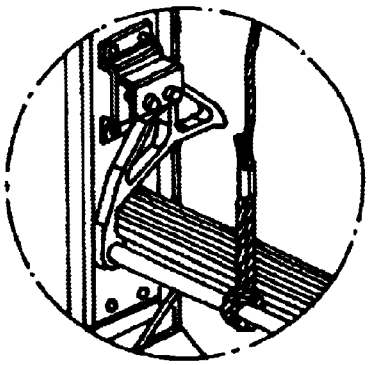

Reference will now be made in detail to the preferred embodiments of the present invention, examples of which are illustrated in the accompanying drawings.

As shown in the various figures, such as FIGS. 1A, 1B, 1C, 1D, 2A, 2B, 2C and 3, an extension ladder is provided having various components in accordance with the present invention. The extension ladder is designated generally by reference numeral 10 and includes a master ladder 1, a slave ladder 2, a pulley A, a locking mechanism B, an anti-slipping mechanism C and adjustable ladder feet D.

The master ladder 1 and the slave ladder 2 are parallel with respect to each other and are assembled together to form the extension ladder 10. The master ladder 1 and the slave ladder 2 are each composed of two posts P and a plurality of rungs R arranged in a spaced-apart configuration with respect to each other. Each of the plurality of rungs R is arranged perpendicular with respect to its respective post P. The master ladder 1 is slightly wider than the slave ladder 2.

The master ladder posts MPs and the slave ladder posts SPs are made of glass fiber reinforced plastic section material with square G-shaped cross section. The master ladder posts MPs open inwardly (towards the rungs), and the slave ladder posts SPs open outwardly (away from the rungs). The master and slave ladder posts interlock, and are oriented side-by-side with each other in a locked configuration.

Internal position limiting plates 21 are installed at the lower part of the two slave ladder posts SPs, and external position limiting plates 22 are installed at the upper part of the two master ladder posts MPs. When the master ladder 1 and the slave ladder 2 slide relative to each other to a certain position, a limiting groove of the internal position limiting plate 21 engages the master ladder posts MPs. At the same time, a limiting groove of the external position limiting plate 22 holds the slave ladder posts SPs. This structure ensures a safer and reliable contact between the master ladder 1 and the slave ladder 2 as shown in FIG. 3.

Figure 2A:
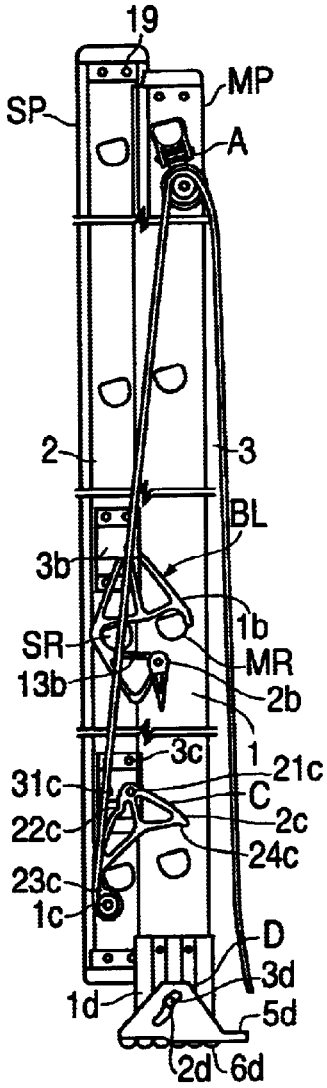
FIG. 2A is a side cross-sectional view of the ladder shown in FIG. 1A illustrating the anti-slipping mechanism under normal operating conditions.
Figure 2B:
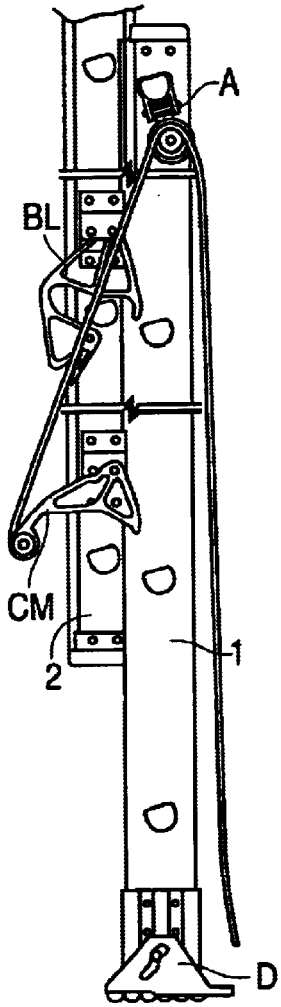
FIG. 2B is a side cross-sectional view of the ladder shown in FIG. 1A showing the anti-slipping mechanism in an upward extended position.
Figure 3:
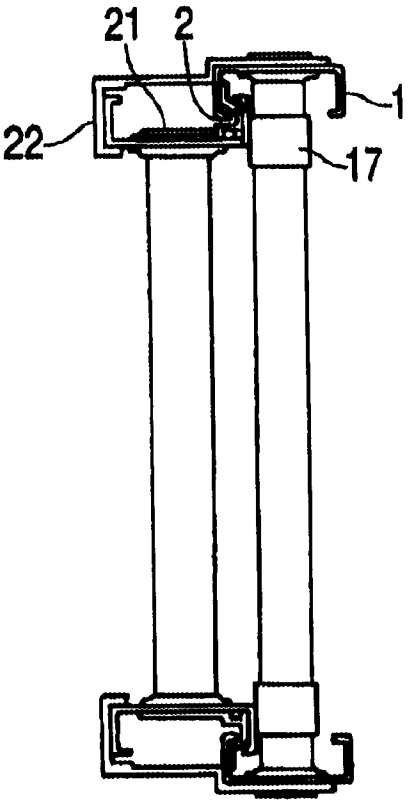
FIG. 3 is an enlarged side view of the internal and external position limiting plates of the ladder shown in FIG. 1A.

Anti-wearing sleeves 17 are provided to the master ladder rungs MRs and positioned to contact the two slave ladder posts SPs as shown in FIG. 3. Corner guards 19 are installed on the top of each ladder post by means of rivets as shown in FIG. 2A. The master ladder posts MPs are provided with the adjustable feet D.

In the pulley A, a fixed pulley 2*a* is installed in the middle of the top rung of the master ladder 1 through a pulley yoke 1*a*. A rope 3 rides the pulley 2*a* with one end being fixed to a link rod 1*c* of the anti-slipping mechanism C secured to the slave ladder posts SPs. The slave ladder 2 is raised up when the rope 3 is pulled, and lowered down when the rope 3 is released.

Figure 5B:
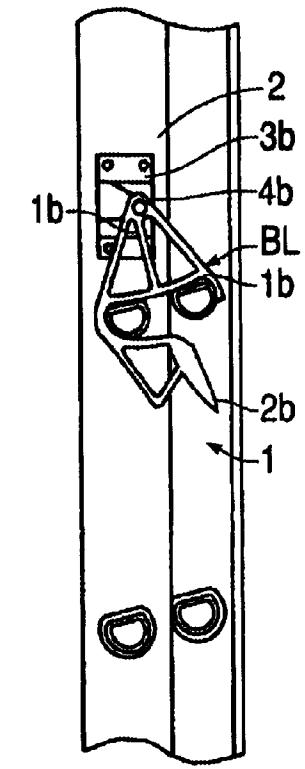
FIGS. 5A, 5B and 5C are various views of a locking mechanism of the ladder shown in FIG. 1A.
Figure 5A:
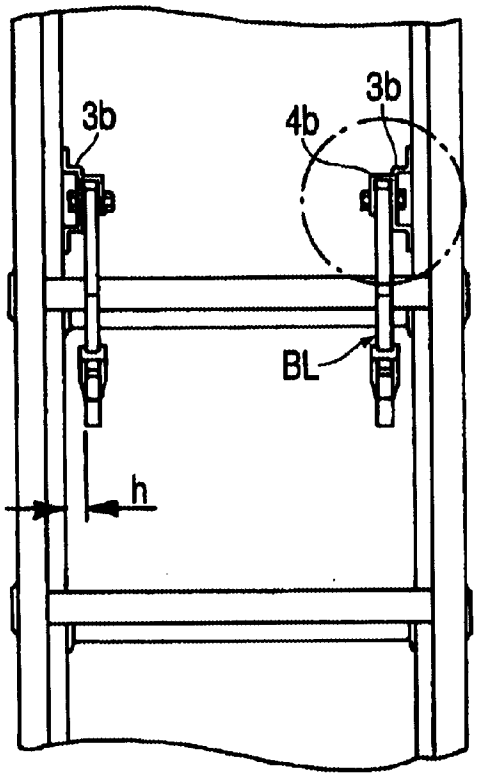
Figure 5C:
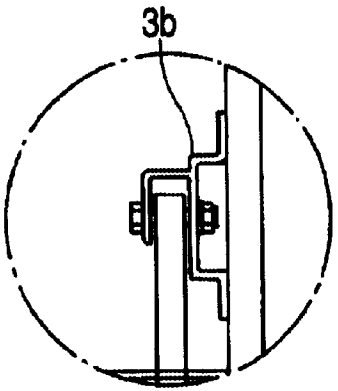
Figure 5D:
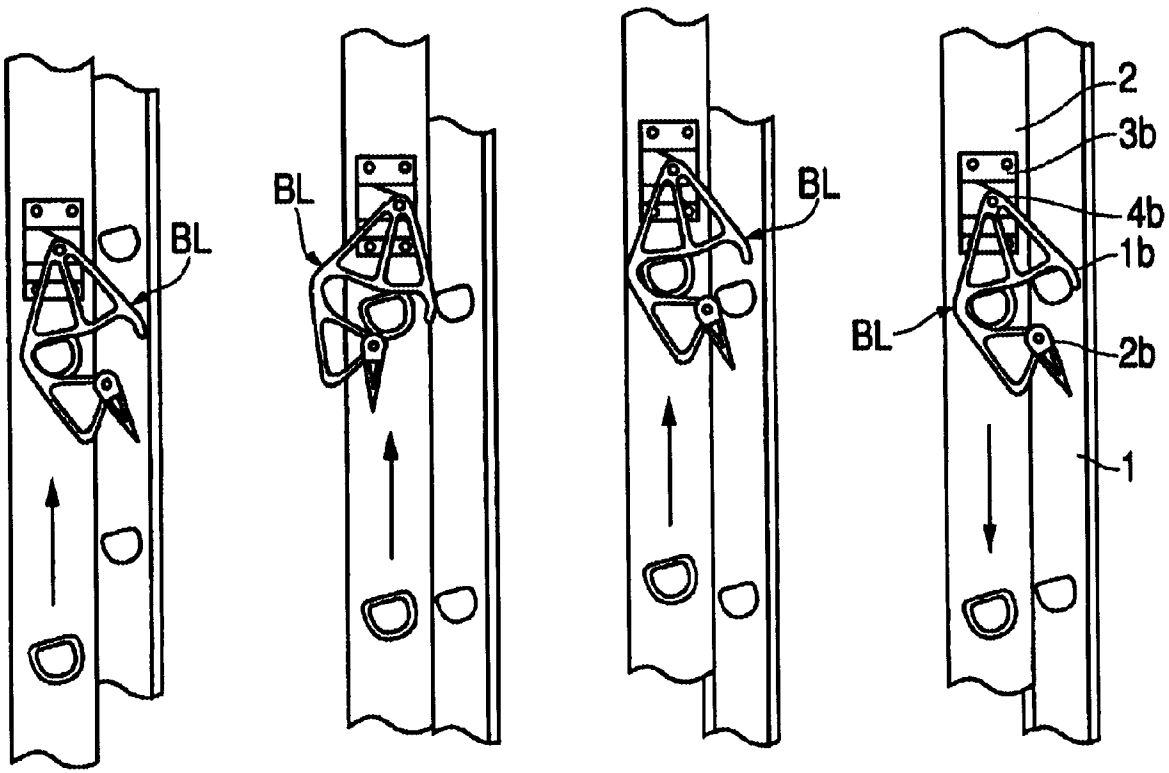
FIG. 5D illustrates four side views of the locking mechanism shown in FIG. 5A in operation.

In the locking mechanism B, a pair of identical locking mechanisms BL are provided at the lower section of the slave ladder 2; each of the two locking mechanisms includes a claw hook 1*b*, a ratchet 2*b*, and a torsion spring 4*b* (FIG. 5A). A hinge hole 21*e* is provided at the end of a vertex angle of the claw hook 1*b* for securing the claw hook 1*b* via a hinge member to a claw hook stand 3*b*. The torsion spring 4*b* is used to keep the claw hook 1*b* always facing towards the master ladder 1 (see FIGS. 5A, 5B and 5C).

The claw hook stand 3*b* is installed at the inside of the slave ladder post SP and is used to let the claw hook 1*b* and the slave ladder post SP be spaced apart by a certain distance. The claw hook 1*b* is hung up from the claw hook stand 3*b* by means of the hinge member which may be a bolt or a nut. A hooking area 13*b* is defined by the claw hook 1*b* for hooking master and slave rungs.

When the slave ladder 2 is lowered down, the ratchet 2*b* hinged on the claw hook 1*b* will be turned by the rung of the master ladder 1 to close the claw hook 1*b* so that the slave ladder 2 can slide down without any obstructions. When the slave ladder 2 is lowered down to a certain position, the claw hook 1*b* will grip the rung of the master ladder 1 to lock it. When the slave ladder 2 is raised up, the claw hook 1*b* will move backwards as turned by the rung of the master ladder 1, and the side frame of the claw hook 1*b* will minimize the resistance against the ladder frame during its movement. When the slave ladder 2 is raised up to a certain position, the claw hook 1*b* will grip the rung of the master ladder 1 to lock the ladder frame into the required position.

The shape of the frame of the claw hook 1*b* is designed to exert a most appropriate force on the claw hook 1*b*. FIG.

Figure 5E:
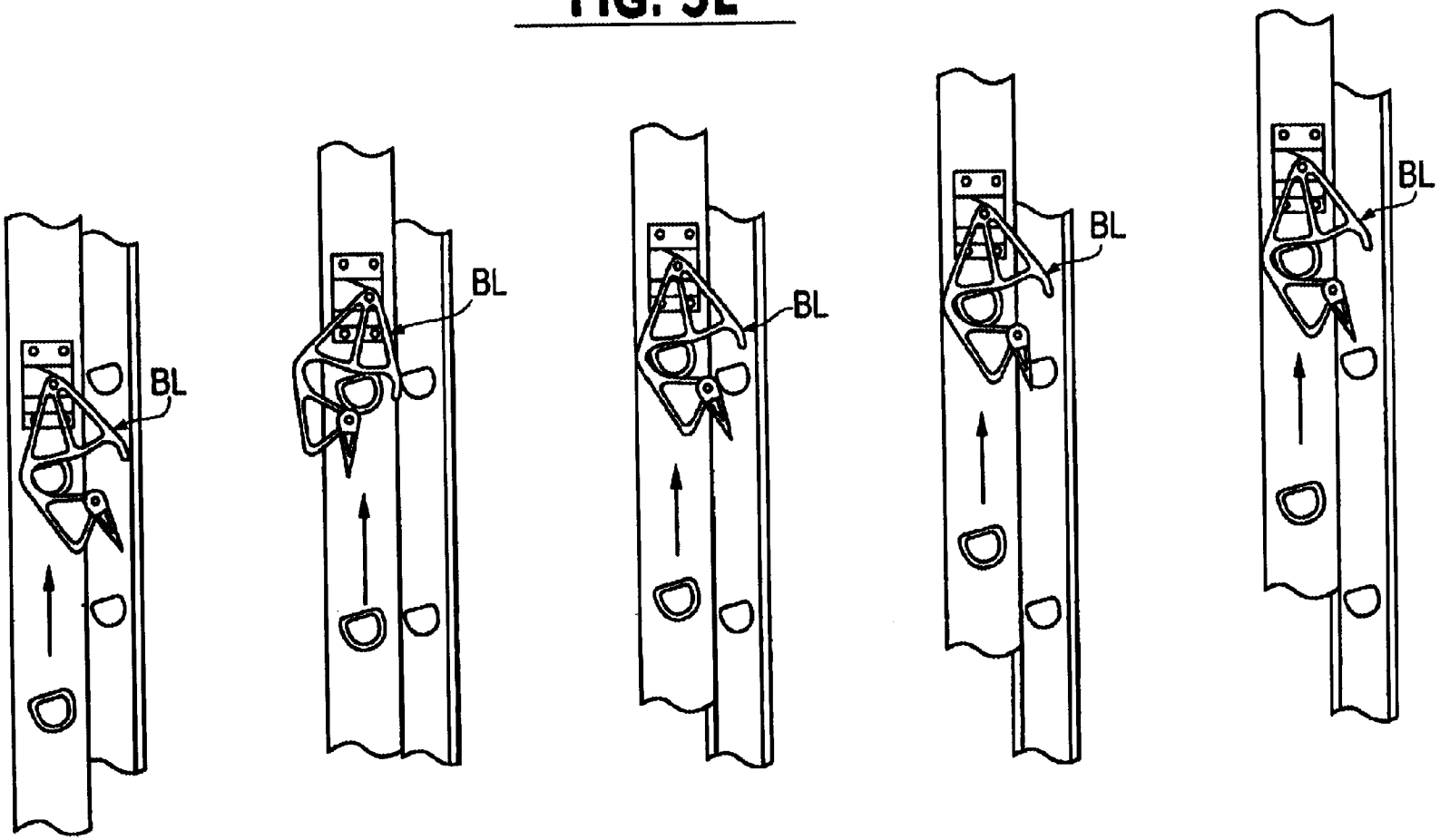
FIG. 5E illustrates four side views of the locking mechanism in operation when the slave ladder of the ladder shown in FIG. 1A is extended upwards.
Figure 5F:
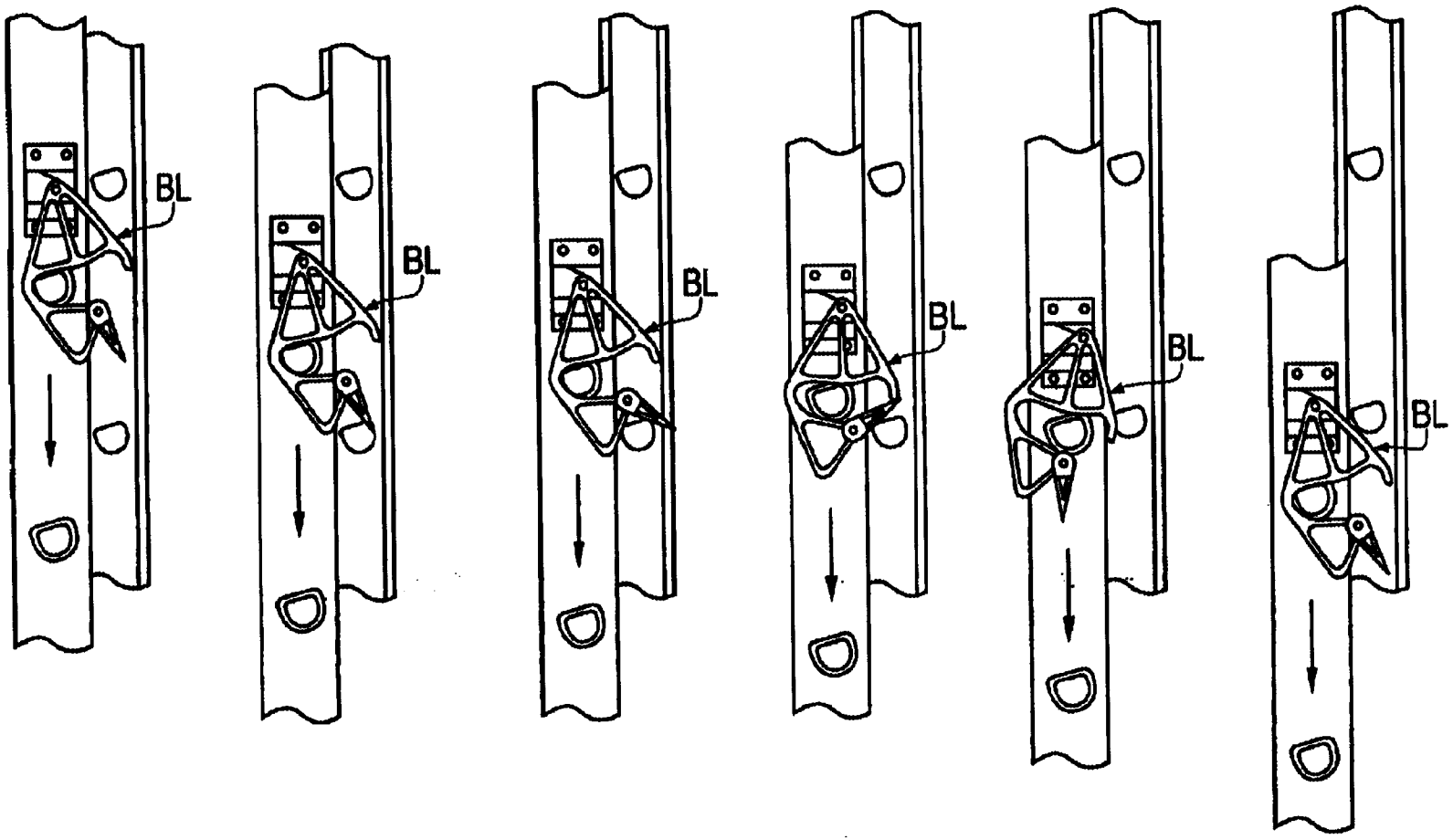
FIG. 5F illustrates five side views of the locking mechanism in operation when the slave ladder of the ladder shown in FIG, 1A is lowered.

5D illustrates four side views of the locking mechanism BL shown in FIG. 5A in operation. FIG. 5E shows the locking mechanism BL when the slave ladder 2 is raised up. FIG. 5F shows the locking mechanism BL when the slave ladder 2 is lowered down.

Figure 6B:
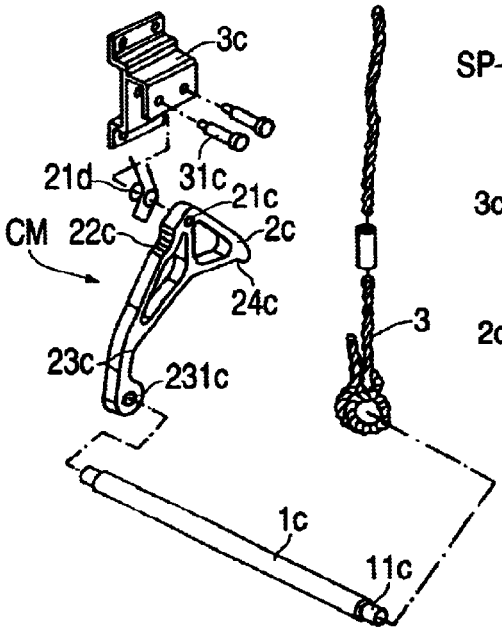
FIG. 6B is an exploded view illustrating the components of the anti-slipping mechanism shown in FIG. 6A.
Figure 6A:
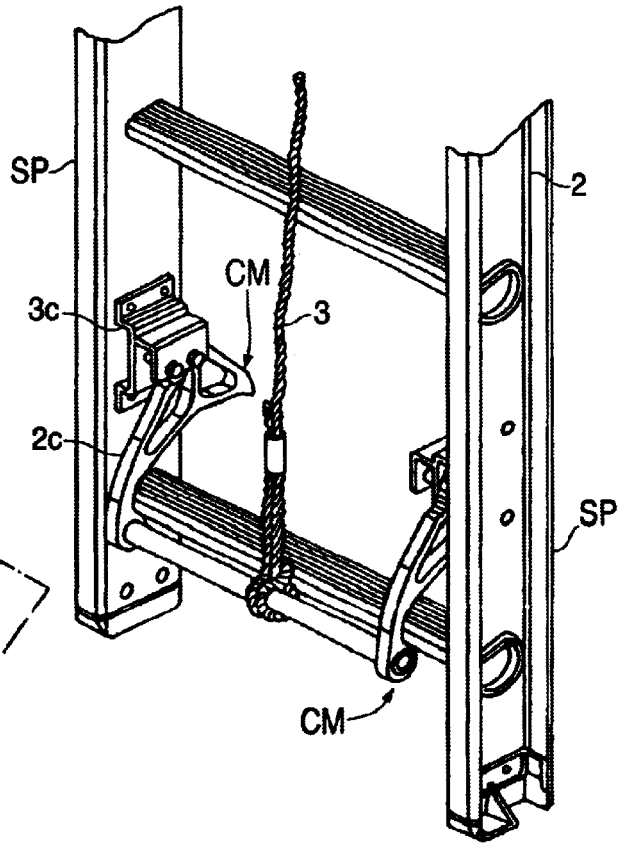
FIG. 6A is an enlarged perspective view of the anti-slipping mechanism of the ladder shown in FIG. 1A.

Referring to FIGS. 6A and 6B, the anti-slipping mechanism C is shown in great detail. The anti-slipping mechanism C includes a pair of anti-slipping mechanisms CM each having a latch hook 2*c* and a latch hook stand 3*c* installed at the inside of the slave ladder post SP and used to space apart the latch hook 2*c* and the slave ladder post SP (see FIG. 2B). Each latch hook stand 3*c* is provided with a hook stop 31*c* to prevent the latch hooks 2*c* from being pivoted beyond a certain point in the clockwise direction (see FIG. 2B).

The anti-slipping mechanism C further includes the link rod 1*c* where the pair of identical latch hooks 2*c* is fixed on the ends of the link rod 1*c*. Each latch hook 2*c* is triangular shaped with a hinge 21*c* on a vertex angle, and is hung up from its respective latch hook stand 3*c* by means of a hinge member. A torsion spring 21*d* is installed at the hinge end of each latch hook 2*c*. Other shapes for the latch hook 2*c* are contemplated within the scope of the present invention.

A first hooking area 23*c* is defined at the long side of the latch hook 2*c* and can be extended inwardly to hook the rung of the slave ladder 2. In particular, the latch hooks 2*c* hook the lowermost rung of the slave ladder 2. An indentation 22*c* that matches or corresponds to the hook stop 31*c* is provided on the long side of each latch hook 2*c*. A second hooking area 24*c* extending inwardly for hooking and supporting a rung of the master ladder 1 is defined on the side opposite the long side. Reducing joining sections 11*c* are formed at both ends of the link rod 1*c* and are movably connected to connection holes 231*c* at the ends of the latch hook to secure the link rod 1*c* to the latch hooks 2*c*. As stated above, one end of the rope 3 is fixed to the link rod 1*c*. In particular, one end of the rope 3 is fixed to a central portion of the link rod 1*c*.

Figure 2C:
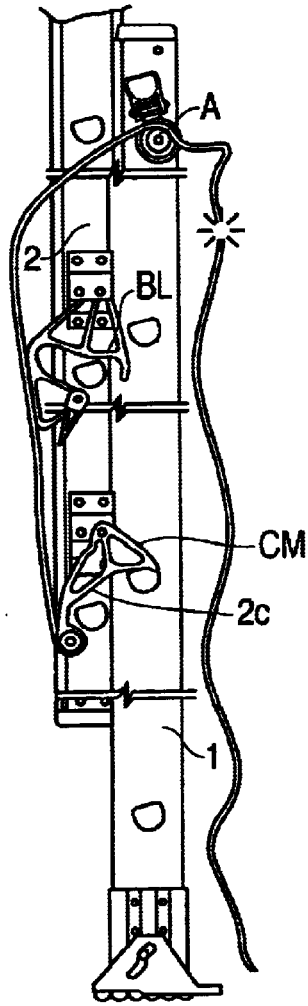
FIG. 2C is a side cross-sectional view of the ladder shown in FIG. 1A showing operation of the anti-slipping mechanism.
Figure 4:
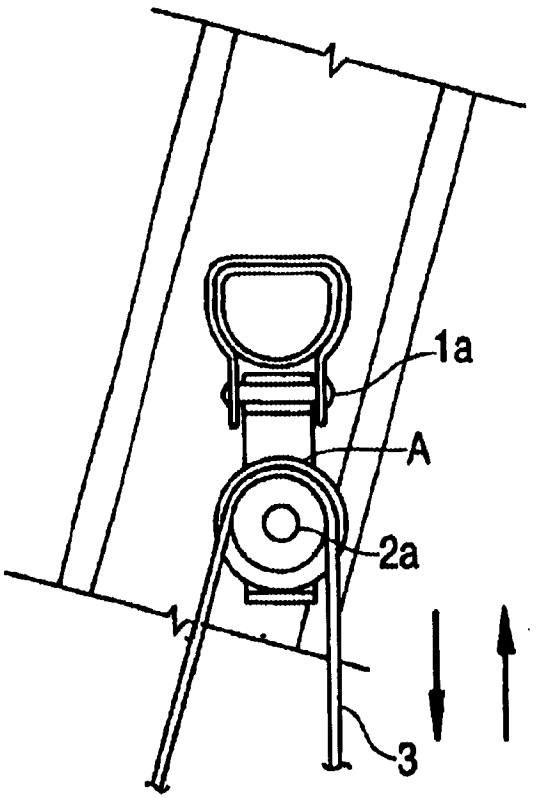
FIG. 4 is an enlarged side view of a pulley of the ladder shown in FIG. 1A.

In case the rope 3 is broken as shown in FIG. 2C, the latch hooks 2*c*, like two powerful hands, will grip the rungs on both the master ladder 1 and the slave ladder 2 to prevent the slave ladder 2 from sliding down so as to ensure the safety of the operator(s) on the extension ladder 10. The lowermost rung of the slave ladder 2 is hooked by the first hooking area 23*c*, since the anti-slipping mechanisms CM are fixedly positioned via the latch hook stands 3*c* just above the lowermost rung of the slave ladder 2. Anyone of the rungs of the master ladder 1 can be hooked by the second hooking area 24*c* depending on the position of the slave ladder 2 with respect to the master ladder 1.

Figure 7:
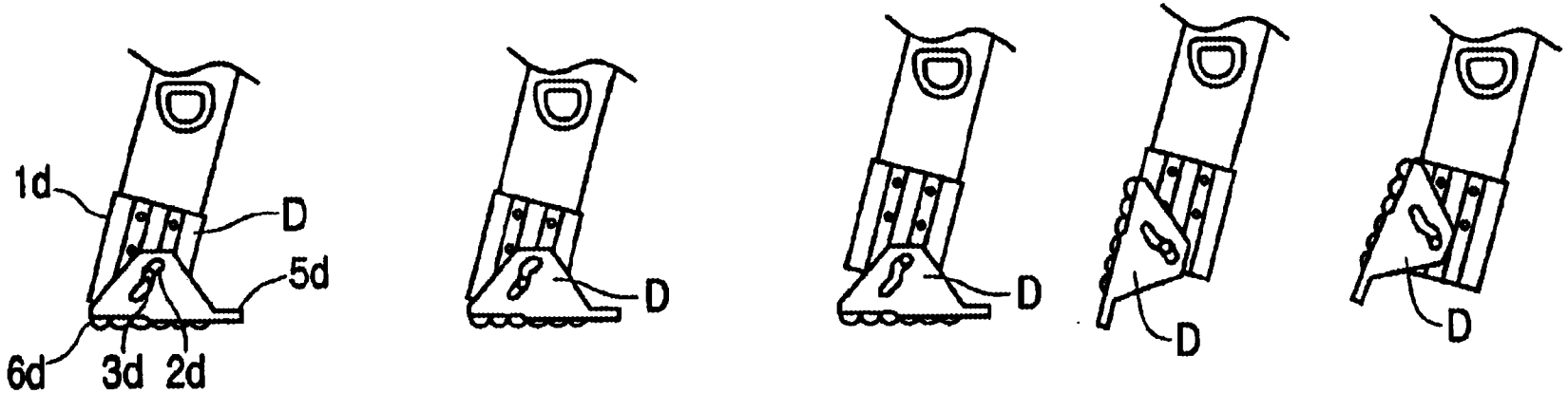
FIG. 7 includes several illustrations of adjustable ladder feet of the ladder shown in FIG. 1A.

With reference to FIG. 7, two identical adjustable ladder feet D are connected at the bottom of the master ladder posts MPs with ladder feet connection pieces 1*d*. The adjustable ladder feet D are provided with curved grooves 2*d* at both sides to hold the ladder feet hinge members 3*d*, such as bolts or nuts. The hinge members 3*d* can move along the curved grooves 2*d* to adjust the ladder feet D along a circular path. Protection teeth 5*d* are provided at the front ends of the adjustable ladder feet D. Polyester anti-slipping plates 6*d* with concave and convex ridges are installed through riveting on the adjustable ladder feet D to strengthen frictional resistance so as to improve the stability of the extension ladder 10.

Reinforcing bars are set in pairs on the rungs and the posts. The lowest rung is preferably riveted with a pair of reinforcing bars to strengthen the firmness of the extension ladder 10.

Compared with prior art ladders, the extension ladder 10 having an anti-slipping mechanism of the present invention has significant advantages and positive effects. It is known from the above technical scheme that the extension ladder 10 in accordance with this invention, with its structural configuration, has at least the following advantages:

First, the anti-slipping mechanism C prevents the slave ladder 2 from being tripped and slid down, thereby safeguarding the safety of a user of the ladder. Second, the pulley A and the locking mechanism B make the extension ladder 10 suitable for various height requirements on work sites.

Third, the adjustable ladder feet D make the extension ladder 10 stand firm and secure by fine and minor adjustment of angles to accommodate different surface or ground conditions the ladder 10 is placed upon. The adjustable ladder feet D are insulated and durable, and prevent slipping. Fourth, the ladder posts are made of glass fiber reinforced plastic section material, thereby providing strength to the ladder 10.

While the invention has been shown and described with reference to certain preferred embodiments thereof, it will be understood by those skilled in the art that various changes in form and details may be made therein without departing from the spirit and scope of the invention as defined by the appended claims. The foregoing embodiments and advantages are merely exemplary and are not to be construed as limiting the present invention. The description of the present invention is intended to be illustrative, and not to limit the scope of the claims. Many alternatives, modifications, and variations will be apparent to those skilled in the art. Thus, it is intended that the present invention cover the modifications and variations of this invention provided they come within the scope of the appended claims and their equivalents.

What is claimed is:

1. An extension ladder comprising:

a master ladder;

a slave ladder;

a pulley;

a locking mechanism; and an anti-slipping mechanism; wherein the master ladder and the slave ladder form a ladder assembly; wherein the master ladder and the slave ladder are each composed of two posts and a plurality of rungs; and wherein the plurality of rungs of the master and slave ladders are arranged in a spaced-apart configuration with respect to each other and are perpendicular to their respective post;

in the pulley, a fixed pulley is provided near the top of the master ladder of which a rope rides through for raising the slave ladder by pulling on the rope;

in the locking mechanism, a pair of identical locking mechanisms are provided each having a claw hook connected to a claw hook stand secured at an inner side location of the slave ladder post for connecting the claw hook to the slave ladder post, a hooking area is defined by each claw hook for hooking at least one rung of the master and slave ladders; and in the anti-slipping mechanism, two latch hook stands are provided for securing a respective latch hook fixed on an end of a link rod to one of the two slave ladder posts, wherein each latch hook defines a first hooking area for hooking at least one rung of the slave ladder and a second hooking area for hooking at least one rung of the master ladder.

2. The extension ladder of claim 1, wherein anti-wearing sleeves are installed on the rungs of the master ladder in a position being in contact with the two slave ladder posts.

3. The extension ladder of claim 1, wherein corner guards are installed on at least one end of each ladder post.

4. The extension ladder of claim 1, wherein an internal position limiting plate is installed at a lower part of the two slave ladder posts, and an external position limiting plate is installed at an upper part of the two master ladder posts.

5. The extension ladder of claim 1, further comprising two identical adjustable ladder feet connected at a lower end of the master ladder posts.

6. The extension ladder of claim 1, wherein the rope is secured to the link rod, and upon pulling of the rope each of the latch hooks are pivoted with respect to the latch hook stand in a direction away from the master ladder.

7. The extension ladder of claim 1, further comprising means for preventing each of said latch hooks from pivoting beyond a certain point in the clockwise direction.

8. The extension ladder of claim 1, wherein the at least one rung of the slave ladder capable of being hooked by the first hooking area is a lowermost rung of the slave ladder.

9. An extension ladder having a master ladder, a slave ladder, a pulley and a locking mechanism, wherein the master ladder and the slave ladder form a ladder assembly; wherein the master ladder and the slave ladder are each composed of two posts and a plurality of rungs; and wherein the plurality of rungs of the master and slave ladders are arranged in a spaced-apart configuration with respect to each other and are perpendicular to their respective post; in the pulley, a fixed pulley is provided near the top of the master ladder of which a rope rides through for raising the slave ladder by pulling on the rope; and in the locking mechanism, a pair of identical locking mechanisms are provided each having a claw hook connected to a claw hook stand secured at an inner side location of the slave ladder post for connecting the claw hook to the slave ladder post, a hooking area is defined by each claw hook for hooking at least one rung of the master and slave ladders, said extension ladder further comprising:

an anti-slipping mechanism comprising:

two latch hook stands for securing a respective latch hook fixed on an end of a link rod to one of the two slave ladder posts, wherein each latch hook define a fist hooking area for hooking at least one rung of the slave ladder and a second hooking area for hooking at least one rung of the master ladder.

10. The extension ladder of claim 9, wherein anti-wearing sleeves are installed on the rungs of the master ladder in a position being in contact with the two slave ladder posts.

11. The extension ladder of claim 9, wherein corner guards are installed on at least one end of each ladder post.

12. The extension ladder of claim 9, wherein an internal position limiting plate is installed at a lower part of the two slave ladder posts, and an external position limiting plate is installed at an upper part of the two master ladder posts.

13. The extension ladder of claim 9, further comprising two identical adjustable ladder feet connected at a lower end of the master ladder posts.

14. The extension ladder of claim 9, wherein the rope is secured to the link rod, and upon pulling of the rope each of the latch hooks are pivoted with respect to the latch hook stand in a direction away from the master ladder.

15. The extension ladder of claim 9, further comprising means for preventing each of said latch hooks from pivoting beyond a certain point in the clockwise direction.

16. The extension ladder of claim 9, wherein the at least one rung of the slave ladder capable of being hooked by the first hooking area is a lowermost rung of the slave ladder.

17. An anti-slipping mechanism for an extension ladder having a master ladder, a slave ladder, a pulley and a locking mechanism, wherein the master ladder and the slave ladder form a ladder assembly; wherein the master ladder and the slave ladder are each composed of two posts and a plurality of rungs; and wherein the plurality of rungs of the master and slave ladders are arranged in a spaced-apart configuration with respect to each other and are perpendicular to their respective post; in the pulley, a fixed pulley is provided near the top of the master ladder of which a rope rides through for raising the slave ladder by pulling on the rope; and in the locking mechanism, a pair of identical locking mechanisms are provided each having a claw hook connected to a claw hook stand secured at an inner side location of the slave ladder post for connecting the claw hook to the slave ladder post, a hooking area is defined by each claw hook for hooking at least one rung of the master and slave ladders, said anti-slipping mechanism comprising:

a first and a second latch hook;

a first latch hook stand for securing the first latch hook at a first inner side location of the slave ladder post;

a second latch hook stand for securing the second latch hook at a second inner side location of the slave ladder post, wherein each of the first and second latch hooks define a first hooking area for hooking at least one rung of the slave ladder and a second hooking area for hooking at least one rung of the master ladder; and a link rod fixedly connected to each of the first and second latch hooks and being substantially parallel to the plurality of rungs.

18. The anti-slipping mechanism of claim 17, wherein the rope is secured to the link rod, and upon pulling of the rope each of the latch hooks are pivoted with respect to the latch hook stand in a direction away from the master ladder.

19. The anti-slipping mechanism of claim 17, further comprising means for preventing each of said latch hooks from pivoting beyond a certain point in the clockwise direction.

20. The anti-slipping mechanism of claim 17, wherein the at least one rung of the slave ladder capable of being hooked by the first hooking area is a lowermost rung of the slave ladder.

* * * * *